United States Patent [19]

Favrot

[11] 4,250,667

[45] Feb. 17, 1981

[54] DEVICE FOR SUPPORTING A CRANKSHAFT HAVING FOUR CRANKPINS ON A GRINDING MACHINE

[75] Inventor: Paul Favrot, Gagny, France

[73] Assignee: Constructions de Clichy, Bobigny, France

[21] Appl. No.: 55,657

[22] Filed: Jul. 6, 1979

[30] Foreign Application Priority Data

Jul. 7, 1978 [FR] France ..... 78 20249

[51] Int. Cl.[3] ..... B24B 5/42

[52] U.S. Cl. ..... 51/237 CS; 51/105 SP

[58] Field of Search ..... 51/237 R, 237 CS, 105 R, 51/105 SB, 105 EC

[56] References Cited

U.S. PATENT DOCUMENTS 2,600,824 6/1952 Zwick ..... 51/237 CS 3,128,582 4/1964 Winter ..... 51/237 CS 3,680,876 8/1972 Omado ..... 51/237 CS

*Primary Examiner*—Harold D. Whitehead

*Attorney, Agent, or Firm*—Hosier, Niro & Daleiden

[57] ABSTRACT

The device comprises two rotary carrier-plates each fitted with a carriage which is equipped with a chuck for gripping one end of a crankshaft and which is adapted to move on a diametral guide of the carrier-plate. The plane of the axes of the crankpins is located in the plane of displacement of the axes of the jaws on each side of the axis of rotation of the carrier-plates at a distance equal to the radius "r" of rotational motion of the crankpins for the successive grinding of the outer crankpins and of the inner crankpins.

The invention is applicable to machines for grinding the crankpins of crankshafts having four crankpins located in the same plane.

4 Claims, 11 Drawing Figures

Y'
209
213
221
XI
218
8
$f_4$
221
222
225
X
X'
226
27
209
227
204A
60°
224
214
204
17
$f_5$
Y
141A
XI
141A
21

DEVICE FOR SUPPORTING A CRANKSHAFT HAVING FOUR CRANKPINS ON A GRINDING MACHINE

This invention relates to devices for supporting crankshafts with four crankpins on grinding machines.

In more exact terms, the invention is directed to a device comprising two rotary carrier-plates for supporting a crankshaft having four crankpins located in the same plane. Each carrier-plate is fitted with a carriage which is equipped with a chuck for gripping one end of a crankshaft to be ground and is slidably mounted on the face of said carrier-plate on a diametral guide. Said carriage is thus capable of moving between two work positions in which the geometrical axis of the chuck is located symmetrically with respect to the axis of rotation of the carrier-plate and at a distance from this latter which is equal to the radius of rotational motion of the geometrical axes of the crankpins. Driving means are provided for bringing and maintaining said carriage selectively in one of said work positions for grinding corresponding crankpins of a crankshaft. Said crankshaft is gripped and positioned angularly within said chucks in such a manner as to ensure that the geometrical plane containing the axes of the crankpins and the axis of the crankshaft is located in the diametral geometrical plane of displacement of the chuck axis with respect to the rotary carrier-plate. In addition, the carrier-plates are adapted to carry movable counterweights for balancing the masses of the equipped carriages and of the crankshaft in respect of each of the two aforementioned work positions of the carriages.

Devices of this type are already known in which the radial displacements of the two carriages on the carrier-plates are carried out by manual operating means. Similarly, the displacements of the balancing counterweights on the carrier-plates are also carried out by manual operating means which are in any case independent of the means for manual operation of the carriages.

The present invention is directed to a mass-production machine of considerably improved design, especially by virtue of the fact that the radial displacements of the carriages on the carrier-plates are produced by driving means which may be automatically controlled and by virtue of the fact that the displacements of the balancing counterweights on the carrier-plates take place automatically as a result of the movements of the carriages, this being achieved by means of a suitable transmission system. In one advantageous embodiment, the balancing counterweights are capable of sliding on the carrier-plates in a direction opposite to the carriages under the action of a toothed rack and pinion system. In an alternative embodiment, the counterweights are carried by arms which are capable of pivotal displacement on the carrier-plates under the action of a train of pinions.

A more complete understanding of the invention will be gained from the following description and from a study of the accompanying drawings in which one embodiment of a device according to the invention for supporting a crankshaft having four crankpins on a grinding machine is shown by way of example, and in which.

Figure 1:
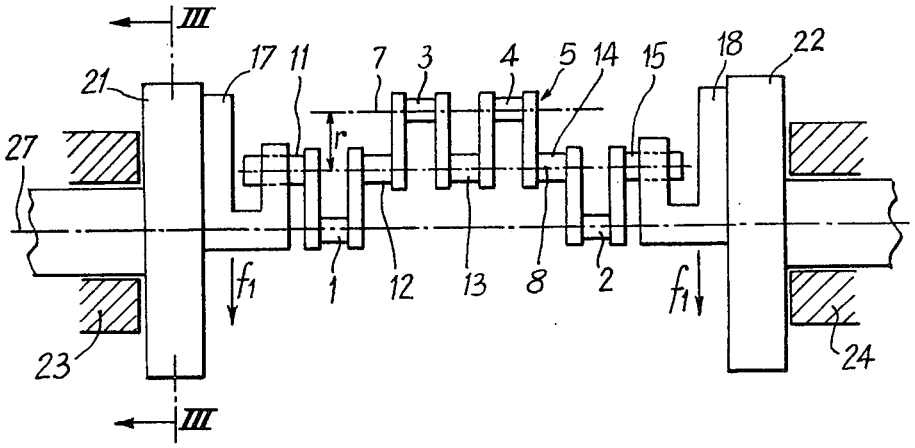
FIGS. 1 and 2 are schematic illustrations of the device which serves to support the crankshaft for grinding the two outer crankpins and for grinding the two inner crankpins respectively, said device being shown in its two work positions.

The device shown in the drawings is employed for grinding the outer crankpins 1, 2 (shown in FIGS. 1 and 2) and the inner crankpins 3, 4 of the crankshaft 5 of a four-cylinder internal combustion engine. The common geometrical axis 6 of the outer crankpins 1, 2 and the common geometrical axis 7 of the inner crankpins 3, 4 are located in the same geometrical plane which also contains the geometrical axis 8 of the crankshaft bearings 11, 12, 13, 14, 15.

The crankshaft is supported at both ends which are gripped in jaws, said jaws being carried by two carriages 17, 18 which are capable of sliding along a diameter respectively on the faces of two carrier-plates 21, 22 forming part respectively of two poppet heads 23, 24 of a grinding machine. The diameters of the two carrier-plates 21, 22 along which the two carriages 17, 18 are capable of sliding are parallel to each other. The crankshaft is positioned angularly on the carriages in such a manner as to ensure that the geometrical plane containing the geometrical axes of all its crankpins passes through the two diameters aforesaid. Thus, in order to grind the two outer crankpins 3, 4 of the crankshaft, the two carriages 17, 18 are displaced simultaneously in sliding motion on the carrier-plates 21, 22 until the geometrical axis 6 of said crankpins coincides with the common geometrical axis 27 of the two carrier-plates 21, 22 for supporting and driving in rotation. The carrier-plates as well as the grinding-wheel and the remainder of the machine are put into operation in accordance with the usual technique. When this grinding operation has been completed, steps are then taken to carry out the grinding of the two inner crankpins. To this end, the initial step consists in displacing the two carriages 17, 18 simultaneously in the direction of the arrows $f_1$ until they take up the positions shown in FIG. 2 in which the axis 7 of the inner crankpins 3, 4 now coincides with the axis 27 of the carrier-plates 21, 22. In other words, in order to effect the change-over from grinding of the two outer crankpins 1, 2 to grinding of the two inner crankpins 3, 4, it has only been necessary to subject the crankshaft 5 to a movement of translation in its own plane, the amplitude of this movement being equal to double the radius of rotational or gyratory motion "r"

of the crankpins. This device clearly offers a great advantage since it removes the difficulties attached to conventional devices by carrying out suitable angular positioning of the crankshaft in one movement of rotation so that one crankpin is moved each time into a position in which it is coaxial with the driving carrier-plates.

The arrangements of the two supporting and driving rotary carrier-plates 21, 22 are identical except for the fact that the left-hand carrier-plate 21 is provided with means for accurate initial angular positioning of the crankshaft whilst the right-hand carrier-plate 22 is provided with means for axial positioning of said crankshaft.

Figure 3:
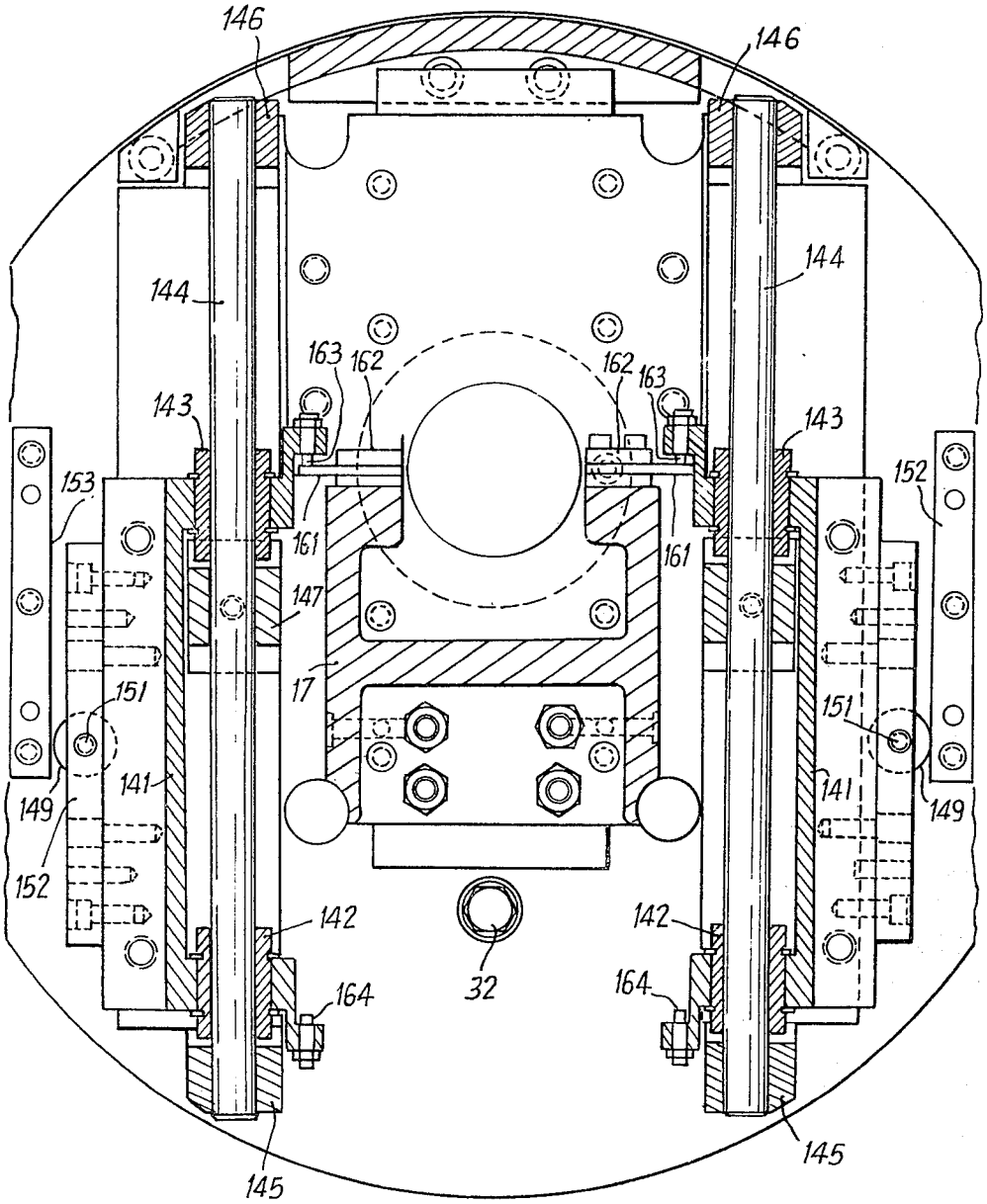
FIG. 3 is a sectional view to a larger scale taken along line III—III of FIG. 1 (and of FIG. 4) showing that portion of the device which is carried by the grinding machine spindle located on the left-hand side of FIG. 1.
Figure 4:
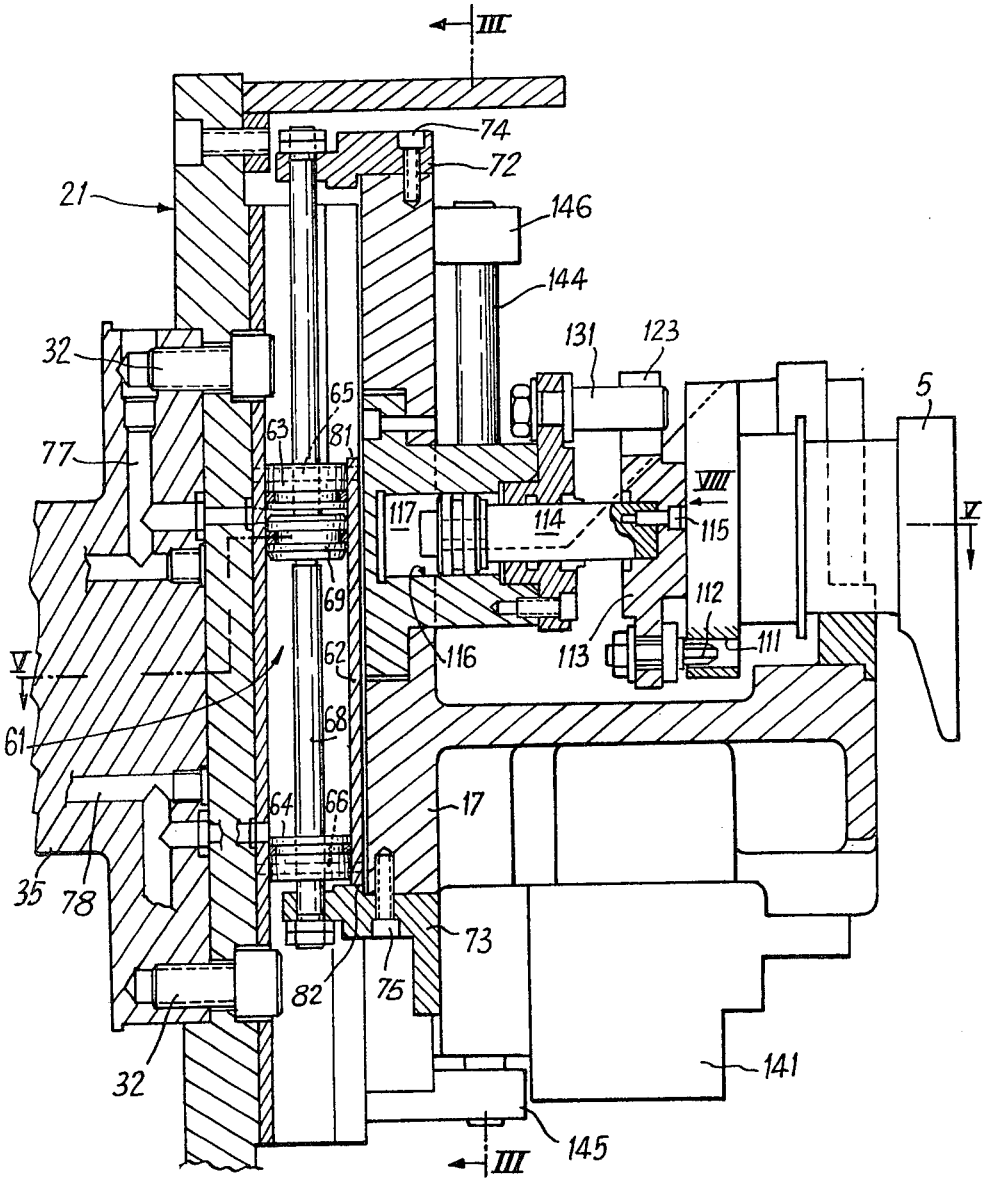
FIG. 4 is a sectional view taken along line IV—IV of FIG. 5.
Figure 5:
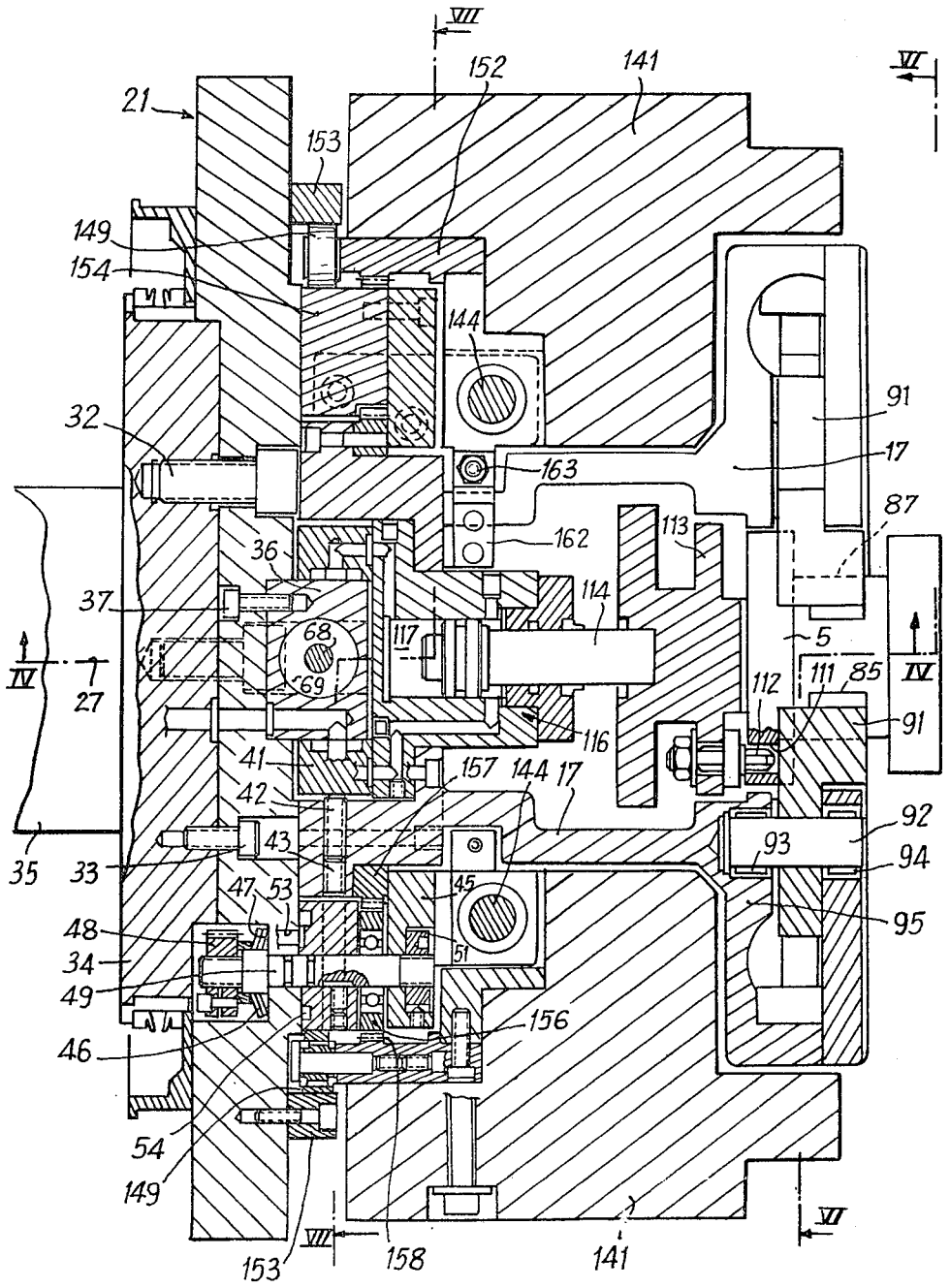
FIG. 5 is a sectional view taken along line V—V of FIG. 4.
Figure 7:
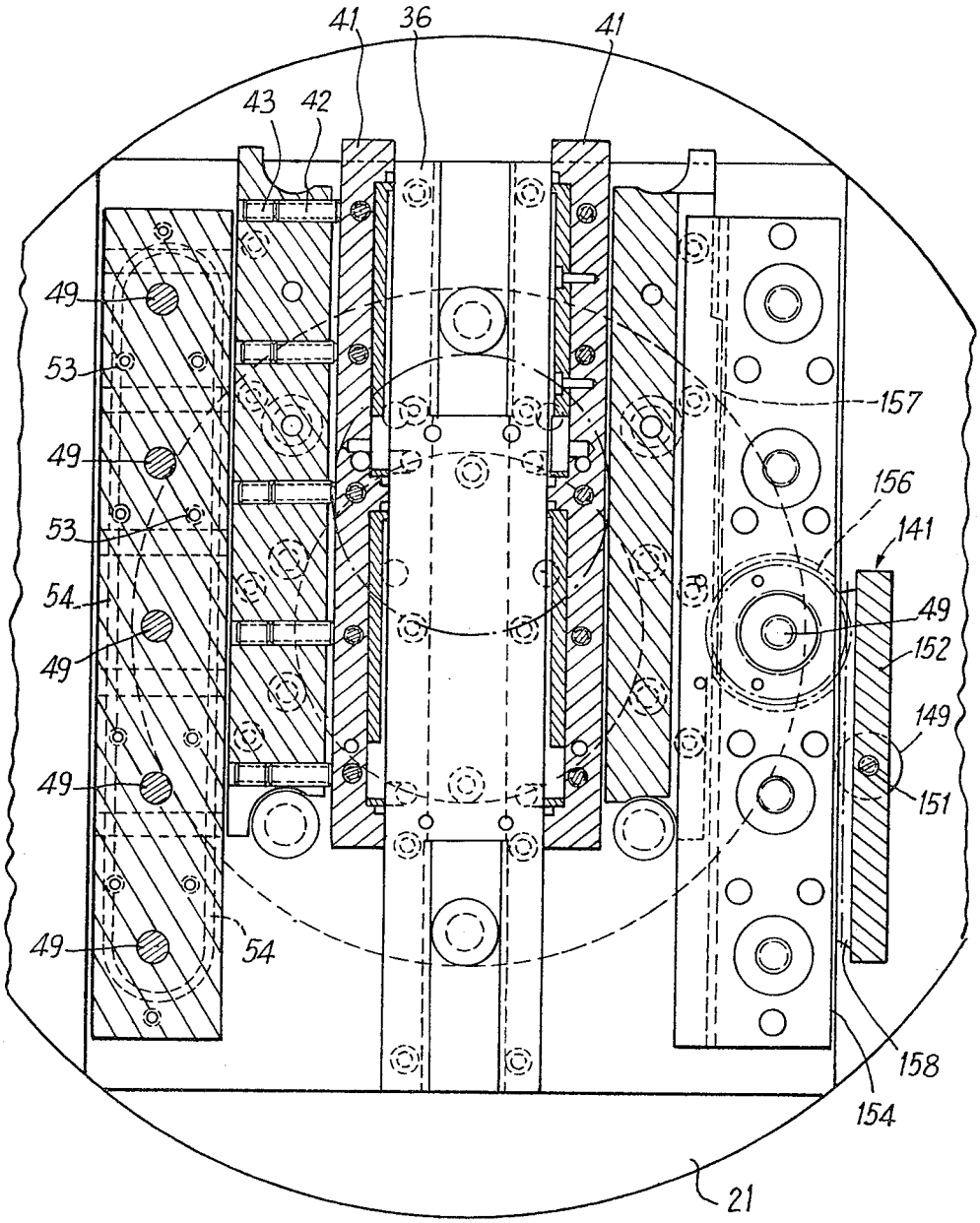
FIG. 7 is a sectional view taken along line VII—VII of FIG. 5.

The arrangement of the left-hand carrier-plate 21 will therefore be described by way of example. This carrier-plate is fixed in position by means of screws 32, 33 (as shown in FIG. 5) on an end flange-plate 34 which forms part of the corresonding left-hand spindle 35 of the grinding machine. The carriage 17 (as also shown in FIGS. 3 and 4) is slidably mounted on a diametral guide 36 fixed on the carrier-plate 21 by means of screws 37; lateral positioning of the carriage is ensured without play by means of two packing-strips 41 (as also shown in FIG. 7) which are applied against the lateral faces of the guide 36 by means of screws 42 which are locked by means of counter-screws 43. The carriage 17 can be maintained powerfully applied against the face of the carrier-plate 21 by means of locking plates 47 which are subjected to the action of resilient washers 46 applied against the end-walls of recesses 47 formed in the carrier-plate 21. Said washers are maintained by means of a nut 48 on one end of a pin 49, the other end of which is adapted to carry a nut 51 which is applied against the locking plate 45. The carriage 17 can be released by lifting the locking plates 47 to a slight extent by delivering oil under pressure within ducts 53 which have their openings between the carrier-plate and the locking plate within a perimeter which is delimited by a seal 54.

The sliding movements of the carriage 17 are produced by a hydraulic jack 61 (shown in FIG. 4). The cylinder 62 of said jack is rigidly fixed to the carriage 17 whilst the two cylinder-ends 63, 64 are secured by means of locking-pins 65, 66 respectively which traverse these latter and the cylinder wall. The rod 68 of the piston 69 extends through the two cylinder-ends and the two ends of said piston-rod are attached respectively to two members 72, 73 which are rigidly fixed to the carriage 17 by means of screws 74, 75. There have been shown at 77 and 78 respectively the ducts for supplying oil under pressure to the two chambers of the jack 61 and for draining these latter under the control of a distributor, depending on the direction in which the jack is intended to displace the carriage. The two ends of travel of the carriage are accurately determined by means of either of the two members 72, 73 which comes into contact with the corresponding end 81 or 82 of the useful portion of the jack cylinder 62.

Figure 6:
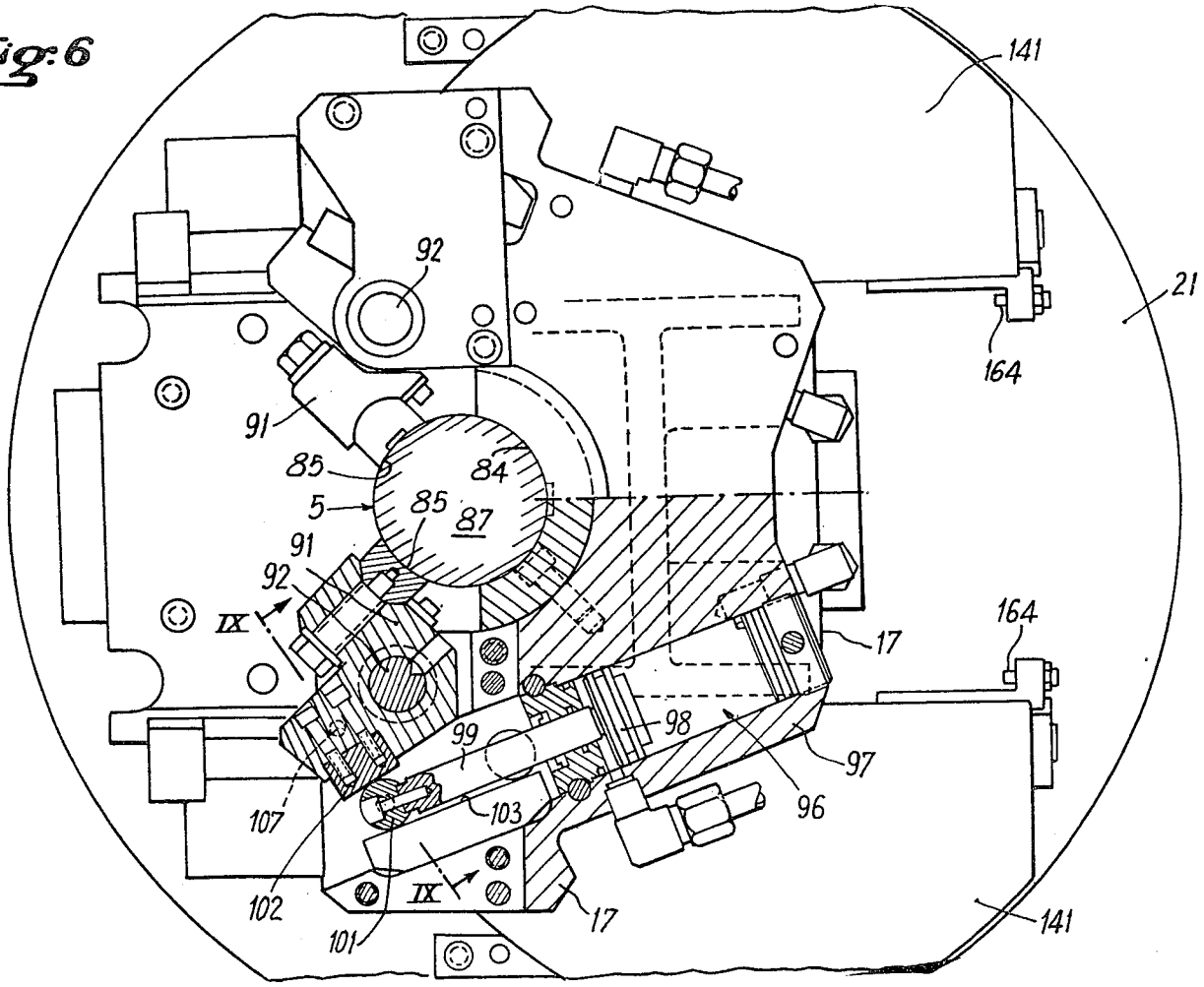
FIG. 6 is a sectional view taken along line VI—VI of FIG. 5.

The carriage 17 is adapted to carry a stationary jaw 84 (shown in FIG. 6) and two movable jaws 85 for gripping one end of the crankshaft 5 to be ground, the gripping action being exerted on a shaft journal 87 at the end of said crankshaft. The stationary jaw 84 extends over an arc which is slightly smaller than 180° in order to prevent any jamming at the time of positioning or removal of a crankshaft.

Figure 9:
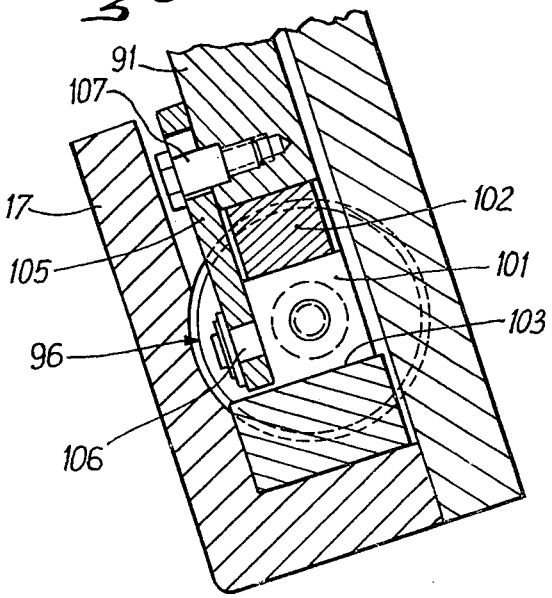
FIG. 9 is a part-sectional view to an even larger scale and taken along line IX—IX of FIG. 6.

Each of the two movable jaws 85 extends over a much shorter arc and is fixed on a block 91 which is rigidly fixed to a pin 92. As shown in FIG. 5, said pin is capable of pivoting within two needle-bearings 93, 94 mounted in a portion of the carriage 17 under the action of a hydraulic jack 96 (shown in FIG. 6). The jack cylinder 97 is rigidly fixed to the carriage 17 and the jack piston 98 is rigidly fixed to a rod 99, said rod being adapted to carry a cylindrical push-rod 101 which is capable of thrusting-back a ramp 102 of the block 91 by sliding against a stationary guide ramp 103 which is rigidly fixed to the carriage 17. The connection between the piston-rod 99 of the jack and the pivoting block 91 is provided continuously over the entire length of travel of the jack by means of a connecting-rod 105 (shown in FIG. 9), the ends of which are pivotally mounted on these two members by means of pins 106, 107 respectively.

Figure 8:
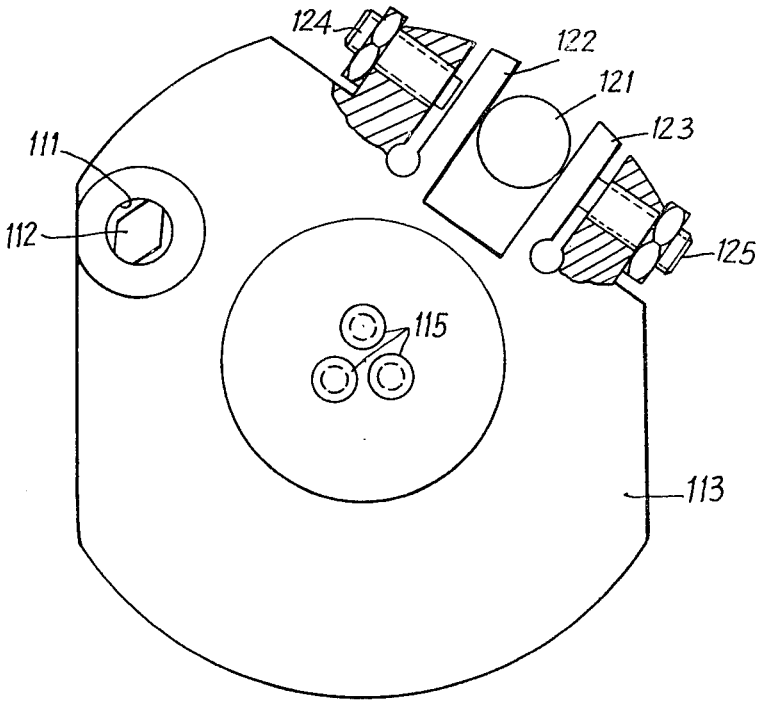
FIG. 8 is a partial end view looking in the direction of the arrow VIII of FIG. 4.

Angular positioning of the crankshaft 5 is effected in the conventional manner by means of a reference hole 111 (as shown in FIGS. 4 and 5) which is formed in said crankshaft and by means of a positioning stud 112 carried by a plate 113, said plate being fixed by means of screws 115 on the outer end of the piston rod 114 of an axial hydraulic jack 116, the cylinder 117 of which is rigidly fixed to the carriage 17. Accurate angular positioning of the plate 113 on the carriage is ensured by means of a stud 131 rigidly fixed to the carriage 17 and imprisoned between two resilient tongues 122, 123 (as also shown in FIG. 8) which are cut in said plate and subjected to the action of two adjusting screws 124, 125.

The assembly consisting of the carriage 17 and the components supported by this latter as well as the crankshaft 5 to be ground are mounted eccentrically with respect to the axis of rotation 27 of the carrier-plate 21 which supports the complete assembly. It is therefore necessary to provide means for balancing all the rotating masses. These means are constituted by two counterweights 141 (shown in FIGS. 3, 4, 5 and 7), said counterweights being arranged symmetrically on both sides of the carriage 17. Each counterweight is slidably mounted by means of two ball-bearing sleeves 142, 143 (shown in FIG. 3) on a cylindrical guide rod 144 supported by the carrier-plate 21 in a direction parallel to the guide 36 of the carriage 17 within two end bosses 145, 146 and by a central boss 147. The counterweight 141 is positioned angularly on the guide rod by means of a roller 149 (shown in FIGS. 3 and 5), the axle-pin 151 of said roller being carried by a member 152 which is rigidly fixed to the counterweight and being adapted to run between a guide rail 153 and a member 156 which are fixed on the carrier-plate 21.

The two counterweights 141 automatically follow the displacements of the carriage 17 in opposite directions by means of a linkage constituted by a toothed wheel 156 (shown in FIGS. 5 and 7) which is loosely mounted on one of the carriage locking pins 49. Said toothed wheel is adapted to engage simultaneously with two toothed racks 157 and 158 respectively which are rigidly fixed to the carriage 17 and to the corresponding counterweight 141.

Devices for damping the ends of travel of the counterweights and of the carriage are constituted by flexible strips 161 (shown in FIG. 3), said strips being inserted at one end in a block 162 which is attached to the carriage 17 whilst the other ends of said strips are capable of bearing against a stop screw 163 at one end of travel. At the other end of travel, said ends are applied against another stop screw 164, said stop screws being both mounted on the counterweights at the ends of these latter. Thus the carriage 17 on the one hand and the two counterweights 141 on the other hand are applied against each other at the moment of common ends of travel by means of flexible damping strips 161.

Figure 2:
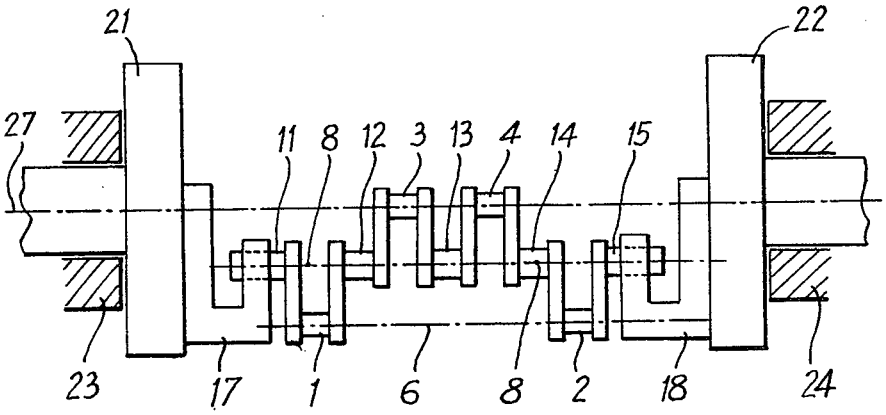

The general principle of operation of the device will not be discussed further since it has already been explained with reference to FIGS. 1 and 2. It will simply be added that the displacements of the two carriages 17, 18 on the corresponding carrier-plates 21, 22 take place in perfect synchronism under the action of hydraulic jacks such as the jack 61 (shown in FIG. 4) by means of a suitable distribution installation which does not form part of the present invention. When the carriages 17, 18 are located at one of their ends of travel, the balancing counterweights 141 are located at their opposite ends of travel, with the result that the rotating system is always automatically balanced. Opening and closing of the chucks 91 for clamping the two ends of a crankshaft against the carriages also take place under the action of hydraulic jacks, namely the jacks such as the jack 96 (shown in FIG. 6). While grinding of a workpiece is in progress, the carriages 17, 18 are maintained powerfully applied against the carrier-plates 21, 22 under the action of the locking plates 45 which are clamped in position by means of the resilient washers 46 (shown in FIG. 5) whereas the locking plates are released by the oil delivered under pressure within the ducts 53 during the displacement of said carriages.

In the embodiment described earlier with reference to FIGS. 1 to 9, the balancing counterweights carry out a movement of translation on the carier-plate in a direction parallel to the direction of translational motion of the crankshaft carriage but in the opposite direction. The following description which is given with reference to FIGS. 10 and 11 relates to an alternative embodiment in which the counterweights are subjected to a pivotal movement on the carrier-plate while the carriage is subjected to a tanslational movement at the same time.

The two counterweights 141A are disposed symmetrically on the carrier-plate 21 with respect to the axis Y–Y′ of displacement of the carriage 17; only one of these counterweights has been shown completely in the drawing.

Each counterweight 141A is rigidly fixed to a shaft 201 which is rotatably mounted by means of two ball-bearings 202, 203 within the ends of the arms of a fork-shaped component 204, the tubular body 205 of which is fixed on a rotatably mounted shaft 206 by means of bearings 207, 208, within a support 209 which is rigidly fixed to the carriage 17. The tubular body 205 of the fork 204 carries a pinion 213 disposed in meshing engagement with a toothed rack 214 fixed on the carrier-plate 21 in a directional parallel to the direction Y–Y′ of displacement of the carriage on the carrier-plate.

By means of a ball-bearing 217, a pinion 218 is rotatably mounted on the shaft 205 which supports the fork 204 and is locked rotationally with respect to the carrier-plate 21 by means of two screws 221 mounted in the support 209 which is rigidly fixed to the carriage, the ends of said screws being applied against a flat face 222 formed on said pinion. This latter is connected to another pinion 224 fixed on the shaft 201 which carries the counterweight by means of a series of odd-numbered pinions, namely three pinions in the example shown as designated respectively by the references 225, 226, 227 and fixed on loosely mounted pins 231, 232, 233 by means of ball-bearings 234, 235, 236 within one arm of the fork 204. In the example considered, the pinion 213 which is adapted to rotate in mesh with the rack 214 has 35 teeth whilst the pinion 224 which is rigidly fixed to the counterweight has 21 teeth. The numbers of teeth of the three intermediate pinions do not have any influence on the ratio of the end pinions. In the case of a rotational displacement of the fork 204 through an angle of 180°, the counterweight carries out a pivotal displacement through an angle of 300° under conditions which will be more readily understood from the following description of the operation of the device.

Figure 10:
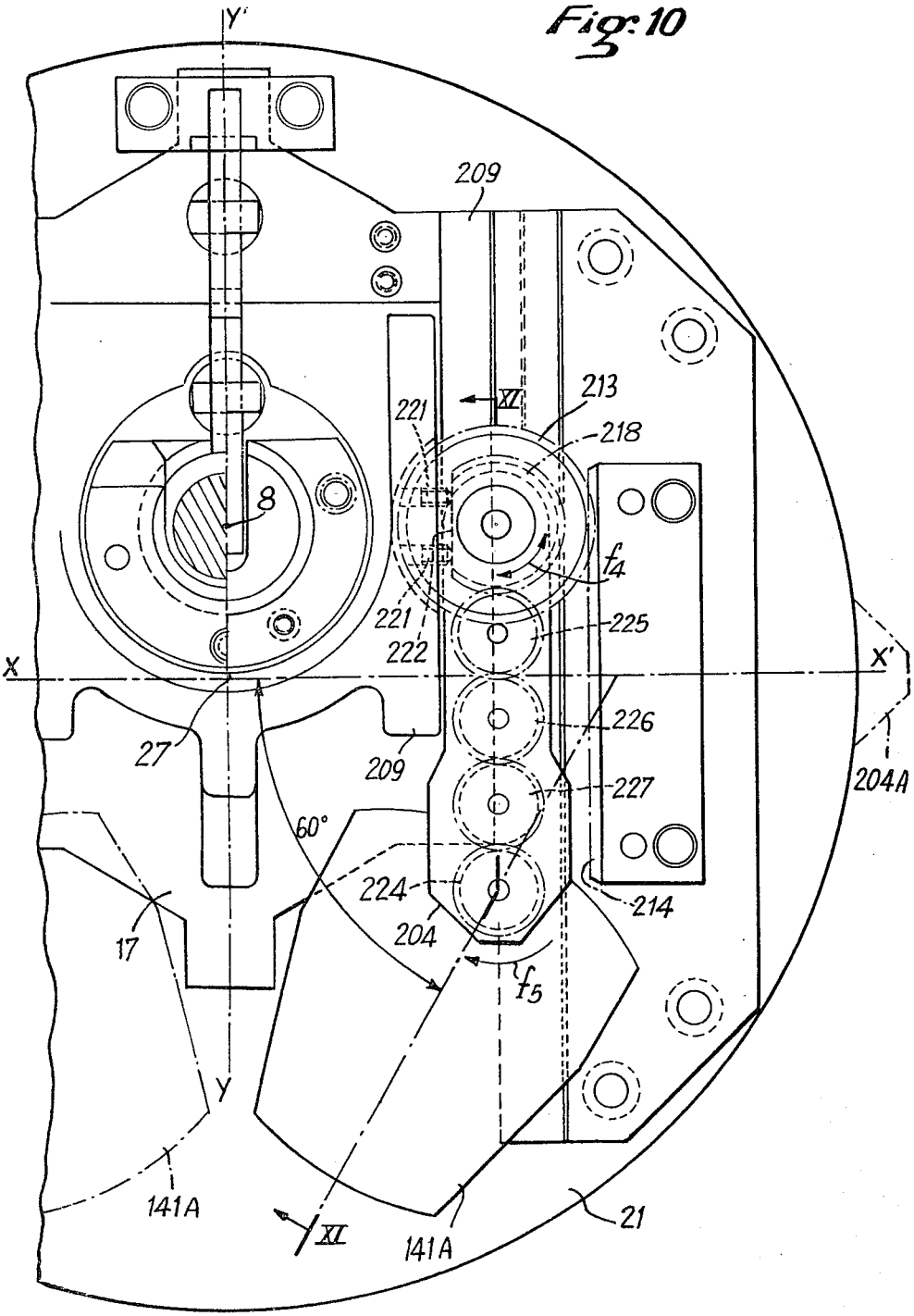
FIG. 10 is a partial view which is similar to FIG. 3 and illustrates an alternative mode of assembly of the balancing counterweights.
Figure 11:
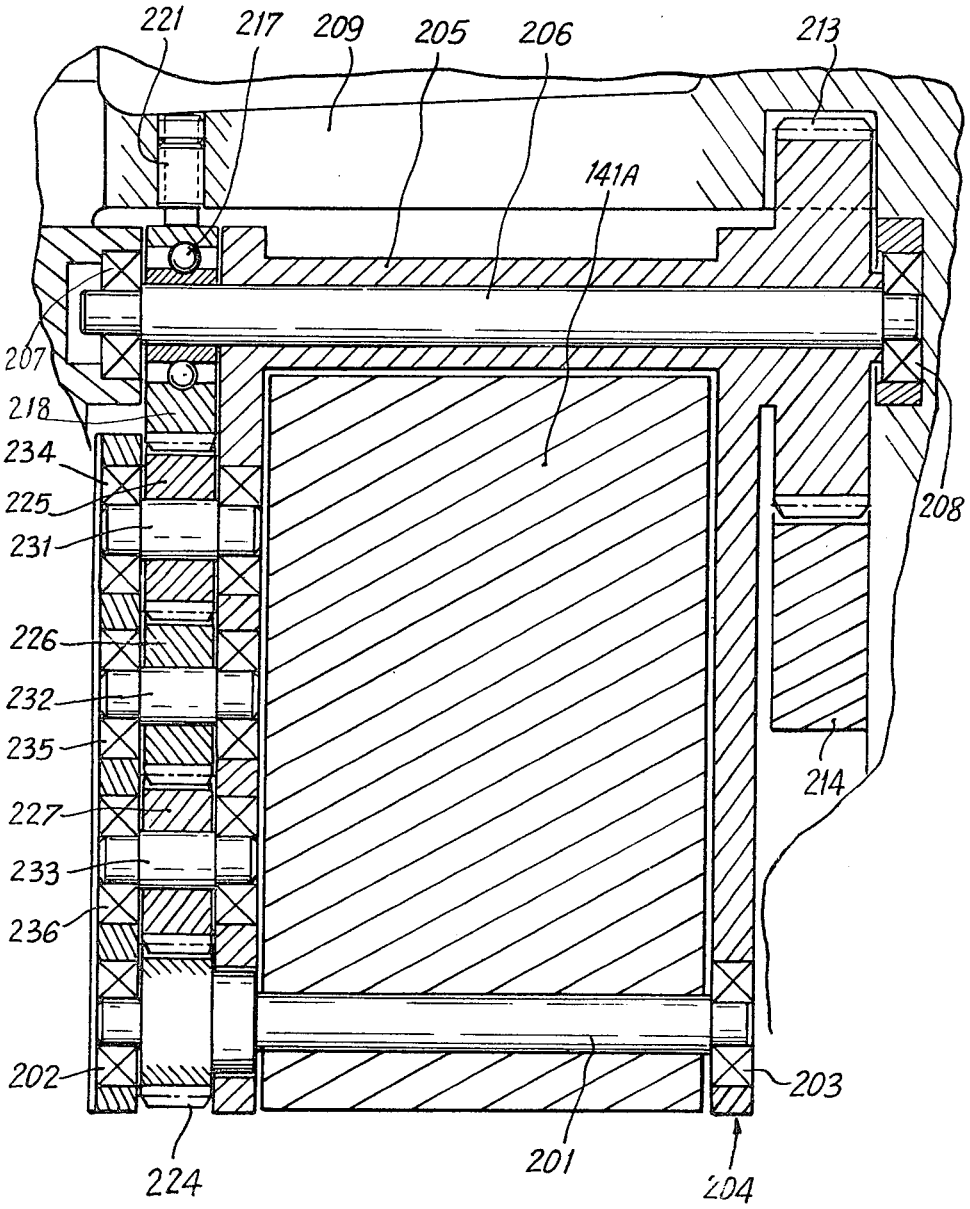
FIG. 11 is a sectional view taken along line XI—XI of FIG. 10, in which it has been assumed that the counterweight and its actuating device have been brought to an intermediate position.

In FIG. 10, the carriage 17 is shown in its top position; the geometrical axis of the jaws which support a crankshaft to be ground is located at the distance "r" (see also FIG. 1) from the geometrical axis 27 of the carrier-plate 21 which is located on the axis X–X′ in FIG. 10. When the carriage moves downwards to its bottom position, it travels over a distance equal to "2r" and is accompanied in its movement by the shaft 205 of the pinion 213; this latter therefore undergoes a rotational displacement against the toothed rack 214 which is rigidly fixed to the carrier-plate 21. In respect of this length of travel, said pinion 213 performs one half-revolution in the direction of the arrow *f*4 and is accompanied by the fork 204. At the point corresponding to mid-travel, said fork passes over the axis X–X′ as shown in chain-dotted lines at 204A in FIG. 10 and continues its movement until its final position which is symmetrical with that shown in the drawing with respect to the axis X–X′. During this period of time, the counterweight 141A which is rigidly fixed to the last pinion 224 has performed a pivotal displacement with respect to the fork in the direction of the arrow *f*5 through an angle of 300° and has therefore pivoted with respect to the carrier-plate in the direction of the arrow just mentioned through an angle of $300° - 180° = 120°$. In the position shown in the drawing, said counterweight was initially inclined at an angle of 60° with respect to the axis X–X′, with the result that it is now inclined once again at an angle of 60° with respect to said axis but on the other side, and that it finally occupies a position which is symmetrical with respect to that shown in the figure. By virtue of this arrangement, the two counterweights do not project beyond the periphery of the circular carrier-plate 21 during their movements. For the sake of enhanced clarity of the drawings, the fork 204 is shown in FIG. 11 in its central position 204A of FIG. 10, with the result that the counterweight is located between its two arms at this instant. It is readily apparent that, when the carriage 17 is displaced upwards, the fork 204 and the counterweight 141A pivot in opposite directions and return to the positions shown in the drawing.

We claim:

1. A device comprising two rotary carrier-plates for supporting a crankshaft having four crankpins located in the same plane on a grinding machine, each carrier-plate being fitted with a carriage equipped with a chuck for gripping one end of a crankshaft to be ground, said carriage being slidably mounted on the face of said carrier-plate on a diametral guide and being thus capable of moving between two work positions in which the geometrical axis of the chuck is located symmetrically with respect to the axis of rotation of the carrier-plate and at a distance from said carrier-plate which is equal to the radius of rotational motion of the geometrical axes of the crankpins, driving means for bringing and maintaining said carriage selectively into one of said work positions for grinding corresponding crankpins of a crankshaft which is gripped and positioned angularly within said chucks in such a manner as to ensure that the geometrical plane containing the axes of the crankpins and the axis of the crankshaft is located in the diametral geometrical plane of displacement of the chuck axis with respect to the rotary carrier-plate, said carrier-plates being further adapted to carry movable counterweights for balancing the masses of the equipped carriages and of the crankshaft in respect to each of the two aforesaid work positions of the carriages, said driving means for producing radial displacements of the carriages on the carrier-plates being of the motor-driven type and wherein said counterweights comprise two movable balancing counterweights mounted on each carrier-plate on each side of the path of travel of the carriage and connected to said carriage by means of a transmission system for causing said counterweights to move with respect to the carrier-plate in the direction opposite to the movement of the carriage.

2. A device as claimed in claim 1, whrein said two counterweights are mounted symmetrically on carrier-plate guides parallel to the diametral carriage guide and wherein said transmission system which connects each counterweight to the carriage comprises a toothed wheel loosely mounted on a pin carried by the carrier-plate and being disposed simultaneously in meshing engagement with two toothed racks rigidly fixed respectively to the carriage and to the corresponding counterweight.

3. A device as claimed in claim 1, wherein each counterweight is carried by the end of a pivotal arm and wherein the transmission system which connects said counterweight to the carriage comprises a toothed wheel rigidly fixed to said arm and carried by a shaft freely mounted for rotation in a support which is rigidly fixed to the carriage, as well as a toothed rack disposed in meshing engagement with said toothed wheel and fixed on the carrier-plate in a direction parallel to the direction of displacement of the carriage on the carrier-plate.

4. A device as claimed in claim 3, wherein said counterweight is pivotally mounted on the end of the pivotal arm and rigidly fixed to a pinion coupled with another pinion which is loosely mounted on the pivotal arm support shaft and which is rigidly fixed only for rotation to the carrier plate and to the carriage by rotational locking members carried by the pivotal arm support.

* * * * *